US006206402B1

(12) United States Patent
Tanaka

(10) Patent No.: US 6,206,402 B1
(45) Date of Patent: Mar. 27, 2001

(54) SNOWBOARD BINDING ADJUSTMENT MECHANISM

(75) Inventor: Toshiyuki Tanaka, Osaka (JP)

(73) Assignee: Shimano Inc., Osaka (JP)

( * ) Notice: Subject to any disclaimer, the term of this patent is extended or adjusted under 35 U.S.C. 154(b) by 0 days.

(21) Appl. No.: 09/181,595

(22) Filed: Oct. 29, 1998

(51) Int. Cl.[7] ..... A63L 9/00
(52) U.S. Cl. ..... 280/607; 280/14.2; 280/618
(58) Field of Search ..... 280/607, 608, 280/617, 618, 620, 623, 14.2; 403/84, 93, 322.4, 322.1; 16/444, 445, 446

(56) References Cited

U.S. PATENT DOCUMENTS

| | | | | |
|---|---|---|---|---|
| 1,786,332 | * | 12/1930 | Bradshaw | 70/165 |
| 3,583,734 | * | 6/1971 | Magi | 287/92 |
| 5,667,237 | * | 9/1997 | Lauer | 280/607 |
| 5,820,155 | * | 10/1998 | Brisco | 280/607 |
| 5,890,729 | * | 4/1999 | Bayer et al. | 280/618 |
| 5,890,730 | * | 4/1999 | Anderson et al. | 280/14.2 |
| 5,975,554 | * | 11/1999 | Linton | 280/607 |
| 5,984,346 | * | 11/1999 | Keller | 280/607 |

FOREIGN PATENT DOCUMENTS

| | | |
|---|---|---|
| 761261A | 3/1997 | (EP) . |
| 852959A | 7/1998 | (EP) . |
| 9327545 | 12/1997 | (JP) . |
| 11253602 | 9/1999 | (JP) . |

* cited by examiner

*Primary Examiner*—Michael Mar
*Assistant Examiner*—Hau Phan
(74) *Attorney, Agent, or Firm*—Shinjyu Global IP Counselors, LLP

(57) ABSTRACT

A snowboard binding adjustment mechanism is provided for adjusting the angular orientation of a snowboard boot relative to a snowboard. The snowboard binding adjustment mechanism can be rotated and locked at various angles relative to the snowboard without the need for tools. The snowboard binding mechanism basically has an adjustment disk adapted to be fixedly coupled to the upper surface of a snowboard, and a base plate having an opening with the adjustment disk positioned therein. A control assembly is formed between the adjustment disk and the base member for locking and unlocking the base plate relative to the adjustment disk. In particular, locking members are movably arranged relative to the adjustment disk and the base plate for engaging internal circumferential teeth formed along the opening of the base plate. A control member is secured for moving the locking members between the locked position and the released position. The control member in selected embodiments is rotatably coupled to the adjustment disk and operatively coupled to the locking members to move the locking members between locked positions and release positions. In one embodiment, a pair of links interconnect the control member to the locking members. In another embodiment, a cam member is utilized to engage the locking members for moving them between the locked positions and the release positions. In one of the embodiments, biasing members or springs are utilized to hold the locking members normally in a locked position.

39 Claims, 10 Drawing Sheets

SNOWBOARD BINDING ADJUSTMENT MECHANISM

BACKGROUND OF THE INVENTION

1. Field of the Invention

This invention generally relates to a snowboard binding mechanism for adjustably securing a snowboard boot to a snowboard. More specifically, the present invention relates snowboard binding adjustment mechanism, which can be rotated and locked at various angles relative to the snowboard without the need for tools.

2. Background Information

In recent years, snowboarding has become a very popular winter sport. In fact, snowboarding was also an Olympic event during the winter games at Nagano, Japan. Snowboarding is similar to skiing in that a rider rides down a snow covered hill. The snowboard is generally shaped as a small surfboard or a large skateboard without wheels. The snowboarder stands on the snowboard with his or her feet generally transverse to the longitudinal axis of the snowboard. Similar to skiing, the snowboarder wears special boots, which are fixedly secured to the snowboard by a binding mechanism. In other words, unlike skiing, the snowboarder has both feet securely attached to a single snowboard with one foot positioned in front of the other foot. The snowboarder stands with both feet on the snowboard in a direction generally transverse to the longitudinal axis of the snowboard. Moreover, unlike skiing, the snowboarder does not utilize poles.

Snowboarding is a sport that involves balance and control of movement. When steering on a downhill slope, the snowboarder leans in various directions in order to control the direction of the movement of the snowboard. Specifically, as the snowboarder leans, his or her movements must be transmitted from the boots worn by the rider to the snowboard in order to maintain control of the snowboard. For example, when a snowboarder leans backward, the movement causes the snowboard to tilt accordingly turning in the direction of the lean. Similarly, leaning forward causes the board to tilt in a corresponding manner and thus causing the snowboard to turn in that direction.

Generally, the sport may be divided into alpine and freestyle snowboarding. In alpine snowboarding, hard boots similar to those conventionally used for alpine skiing are worn, and fitted into so-called hard bindings mounted on the snowboard, which resemble alpine ski boot bindings. In freestyle snowboarding, soft boots similar to ordinary boots, or adaptations of such boots as distinct from hard shell alpine boots are typically worn, fitted into so-called soft bindings.

Accordingly, a snowboarder may want to change the binding orientation depending on the style of snowboarding, snowboarder level of skill and/or rider preferences. Moreover, snowboarders typically ride with their left foot in front of the right foot on the snowboard. However, some snowboarders want to ride with their right foot in front of the left foot on the snowboard (so-called goofy style). In order to accommodate the different styles of snowboarding, the snowboarder level of skill and/or the snowboarder preferences, the bindings have been made to be adjustable so that the snowboarder can adjust the angle of his feet relative to the longitudinal axis of the snowboard. In the past, changing the angle of the snowboarder's stance required the snowboarder to loosen several mounting screws so that the binding may be rotated relative to the snowboard, and then re-tightening the screws. This type of binding is very time consuming in order to change the snowboarder's stance. Moreover, a tool must be used to adjust the snowboarder's stance.

In the snowboarding rental industry, the rental shop must set the stance angle for snowboarder's preference at the time of the rental. Thus, the rental shop must spend a significant amount of time with each renter to adjust the binding according to his or her needs. Moreover, once the renter has left the rental shop, the renter cannot adjust the bindings without having a screwdriver or other tool. Thus, the renter will typically have to go back to the rental shop to have the bindings readjusted in the event the snowboarder desires a different stance angle.

In view of the above, there exists a need for snowboard binding adjustment mechanism that can be rotated and locked at various angles relative to the snowboard without the need for tools and which overcomes the above mentioned problems in the prior art. This invention addresses this need in the prior art as well as other needs, which will become apparent to those skilled in the art from this disclosure.

SUMMARY OF THE INVENTION

One object of the present invention is to provide a snowboard binding adjustment mechanism can be rotated and locked at various angles relative to the snowboard without the need for tools.

Another object of the present invention is to provide a snowboard binding adjustment mechanism that is suitable for use in rental shops.

Another object of the present invention is to provide a snowboard binding adjustment mechanism that is relatively easy to operate.

Another object of the present invention is to provide a snowboard binding adjustment mechanism that is relatively simple and inexpensive to manufacture.

Another object of the present invention is to provide a snowboard binding adjustment mechanism that is relatively lightweight.

In accordance with one aspect of the present invention, a snowboard binding adjustment mechanism is provided that comprises an adjustment disk adapted to be fixedly coupled to an upper surface of a snowboard, and a base plate having an opening with internal circumferential teeth. The adjustment disk is located within the opening of the base plate for relative selective rotation of the base plate about the adjustment disk. A first locking member is movably arranged relative the adjustment disk and the base plate for movement between a locked position and a release position. The first locking member has an engagement end that contacts the internal circumferential teeth in the locked position and is spaced from the internal circumferential teeth in the release position. A control member is rotatably coupled to the adjustment disk and operatively coupled to the first locking member to move the first locking member between the locked position and the release position.

In accordance with another aspect of the present invention, a snowboard binding adjustment mechanism is provided that comprises an adjustment disk adapted to be fixedly coupled to an upper surface of a snowboard and a base plate having an opening with internal circumferential teeth. The adjustment disk is located within the opening of the base plate for relative selective rotation of the base plate about the adjustment disk. A first locking member is movably arranged relative the adjustment disk and the base plate for movement between a locked position and a release position. The first locking member has an engagement end that contacts the internal circumferential teeth in the locked position and is spaced from the internal circumferential teeth in the release position. A spring member is coupled to the first locking member to bias the first locking member to the locked position. A control member is coupled to the adjustment disk and operatively coupled to the first locking member to move the first locking member against the bias of the spring member from the locked position to the release position.

These and other objects, features, aspects and advantages of the present invention will become apparent to those skilled in the art from the following detailed description, which, taken in conjunction with the annexed drawings, discloses three preferred embodiments of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Figure 1:
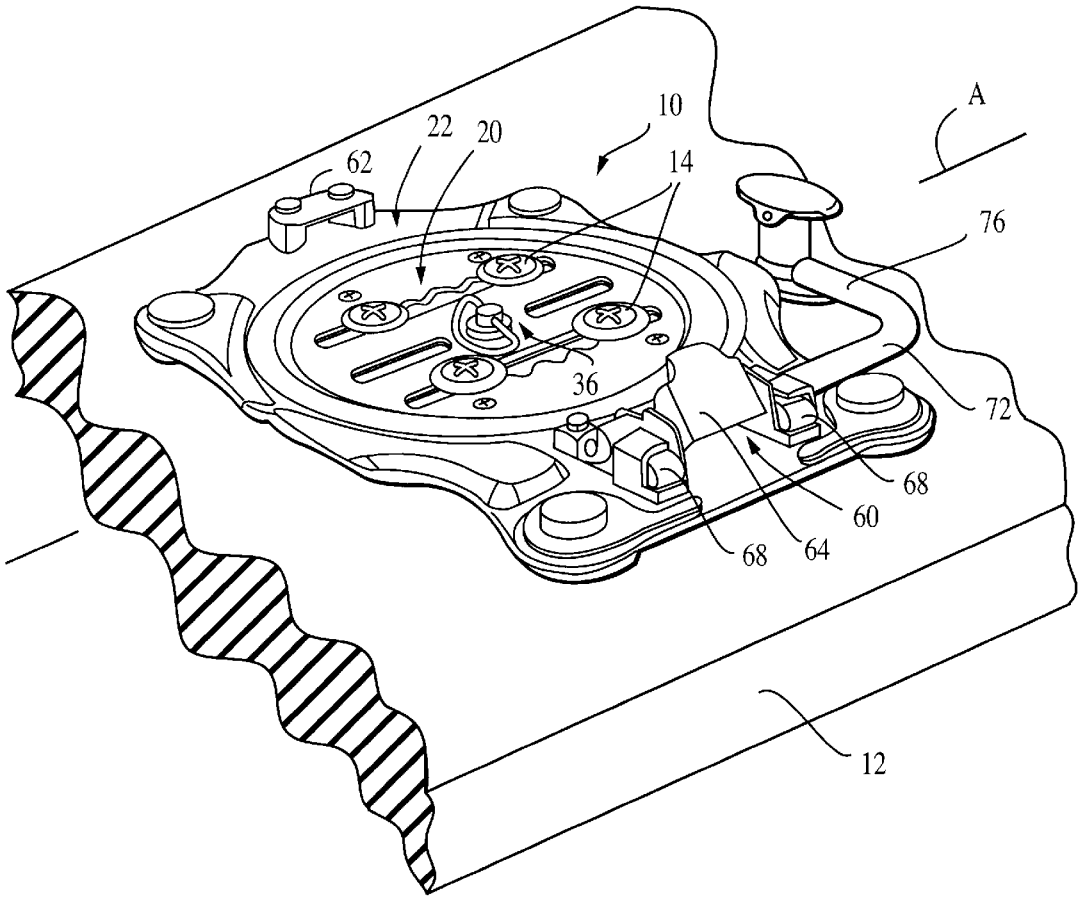
FIG. 1 is a top partial perspective view of a snowboard with a binding mechanism coupled thereto in accordance with a first embodiment of the present invention.

Referring initially to FIG. 1, a snowboard binding mechanism 10 coupled to a snowboard 12 is illustrated in accordance with one embodiment of the present invention. Specifically, binding mechanism 10 is affixed to the top or upper surface of the snowboard 12 via four fasteners or screws 14 in a conventional manner. Typically, snowboard 12 will have a pair of binding mechanisms 10 attached thereto. The binding mechanism 10 is designed to engage and disengage cleats (not shown) which are mounted to the underside of a snowboard boot (not shown). The longitudinal axis of the snowboard 12 is represented by centerline A in FIG. 1.

Basically, snowboard binding mechanism 10 includes an adjustment disk 20 which is fixedly coupled to snowboard 12 via fasteners 14 and a base plate 22 which is angularly adjustable relative to adjustment disk 20 by a control assembly formed between adjustment disk 20 and base plate 22, as discussed below in more detail. Accordingly, adjustment disk 20 is non-movably secured to snowboard 12, while base plate 22 is designed to be releasably coupled to the snowboard 12 via adjustment disk 20. In the preferred embodiment, the base plate 22 can be adjusted in three-degree increments. Of course, the amount of adjustment can be modified as needed and/or desired.

Figure 3:
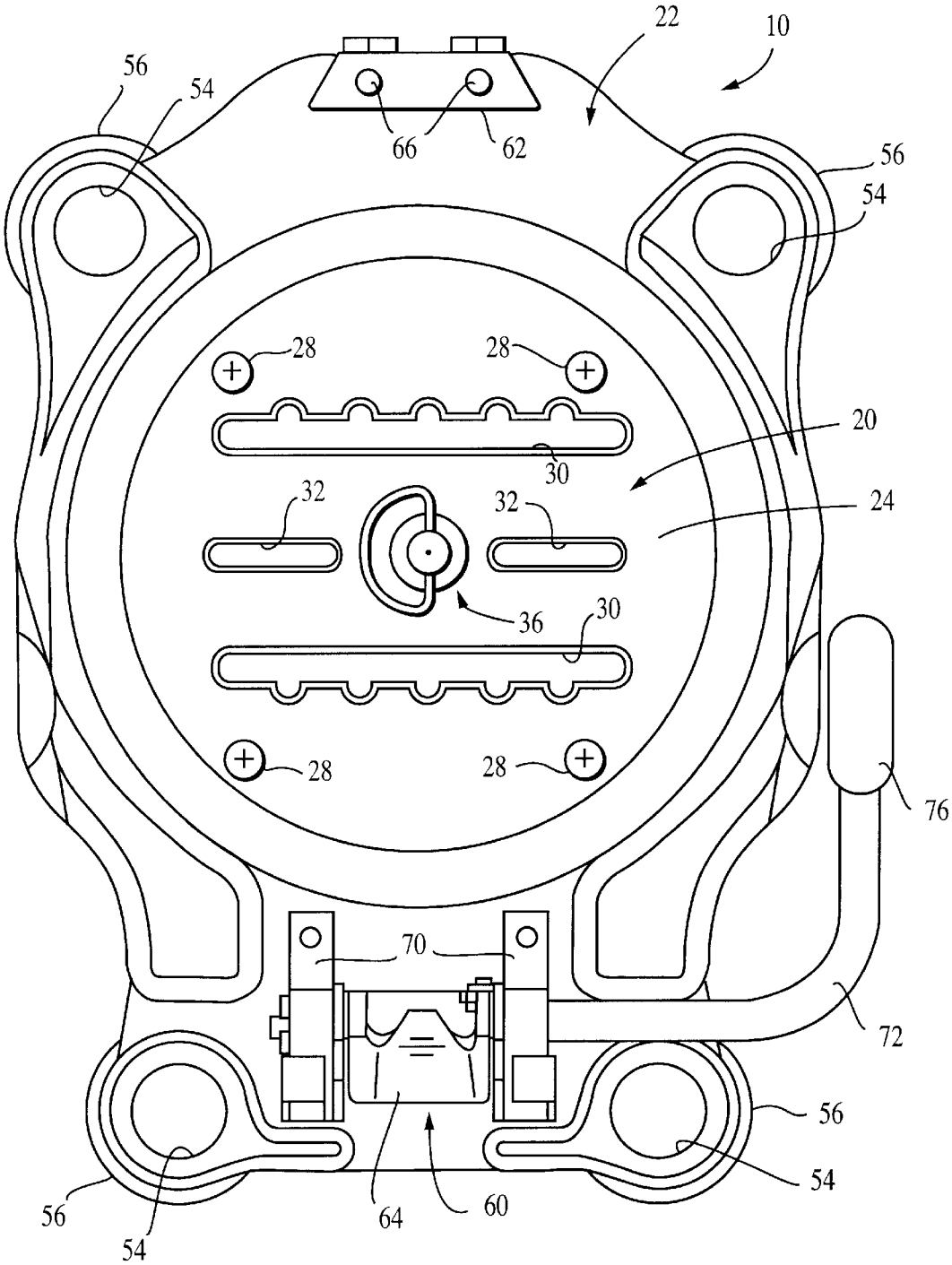
FIG. 3 is a top plan view of the snowboard binding mechanism illustrated in FIGS. 1 and 2 in accordance with the first embodiment of the present invention.
Figure 4:
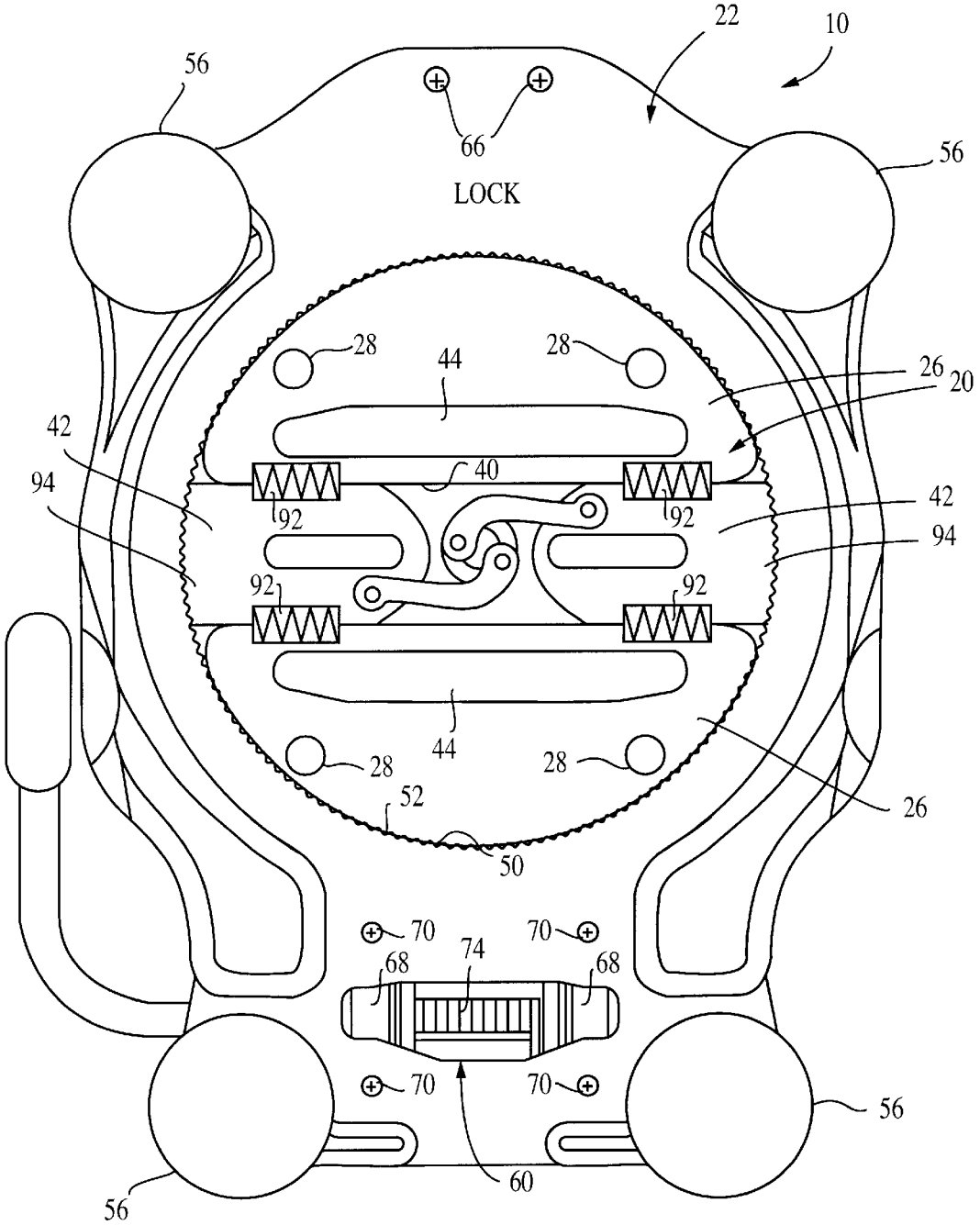
FIG. 4 is a bottom plan view of the snowboard binding adjustment mechanism illustrated in FIGS. 1–3, with the locking members in the locked positions.

As seen in FIGS. 3 and 4, adjustment disk 20 is preferably constructed of three pieces. Specifically, adjustment disk 20 includes an upper plate member 24 and a pair of arc-shaped support members 26 coupled to the bottom surface of plate member 24 via fasteners or screws 28. Of course, adjustment disk 20 could be constructed as a one-piece, unitary member if needed and/or desired. Also, support members 26 can be attached to plate member 24 in a variety of ways. In the preferred embodiment, plate member 24 and support member 26 are constructed of a hard, rigid material. Examples of some preferred materials include steel, titanium, carbon or a carbon-steel combination. A rubber gasket or the like (not shown) is preferably positioned around support members 26 such that the gasket is located between the bottom surface of plate member 24 and the upper surface of base plate 22.

Figure 7:
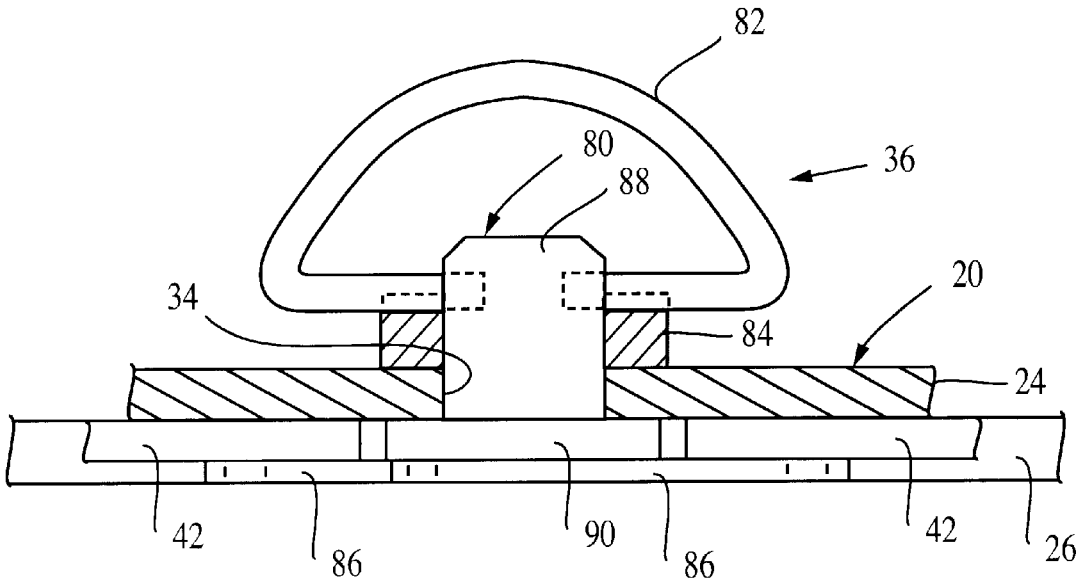
FIG. 7 is a partial cross-sectional view of the adjustment disk for the snowboard binding mechanism illustrated in FIGS. 1–6 in accordance with the first embodiment of the present invention.

Referring now to FIG. 3, plate member 24 is a generally circular member with a pair of elongated mounting slots 30, which are designed to receive fasteners 14 therethrough. Mounting slots 30 are preferably parallel to each other and extend substantially perpendicular to the longitudinal axis A of snowboard 12 when attached thereto. Two additional mounting slots 32 are also provided in plate member 24. Mounting slots 32 are located midway between mounting slots 30 and are substantially parallel thereto. Accordingly, mounting holes 30 and 32 can accommodate a wide variety of snowboards. As seen in FIG. 7, center hole 34 is located at the center point of plate member 24 for attaching control member 36 of the control assembly thereto, as discussed below.

Figure 5:
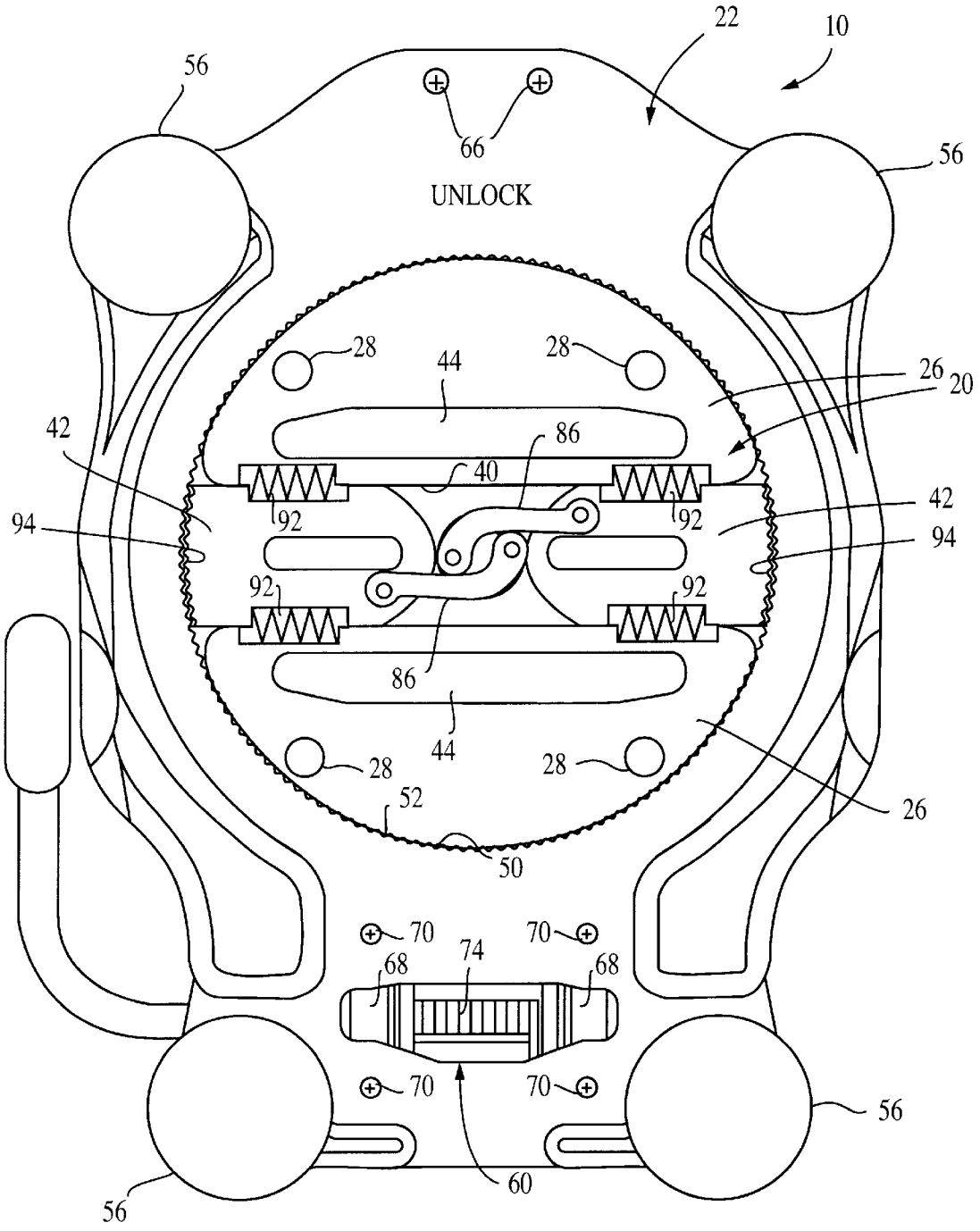
FIG. 5 is a bottom plan view of the snowboard binding adjustment mechanism illustrated in FIGS. 1–4, with the locking members in the unlocked positions.

Referring now to FIGS. 4 and 5, support members 26 are arc-shaped members, which are substantially identical to each other and coupled to the bottom of plate member 24 by fasteners 28. A transverse slot or recess 40 is formed between support members 26 for slidably receiving a pair of locking members 42. Locking members 42 are designed to slide within slot or recess 40 between locked positions and release positions such that the angular orientation of base plate 22 can be changed relative to snowboard 12. When support members 26 are coupled to plate member 24, a pair of slots 44 are aligned with mounting slots 30 so that fasteners 14 can pass through support members 26 and be threaded into threaded bores of snowboard 12.

Base plate 22 is constructed of a hard rigid material. Examples of suitable hard rigid materials for base plate 22 include various metals, as well as carbon and/or a metal/carbon combination.

Figure 6:
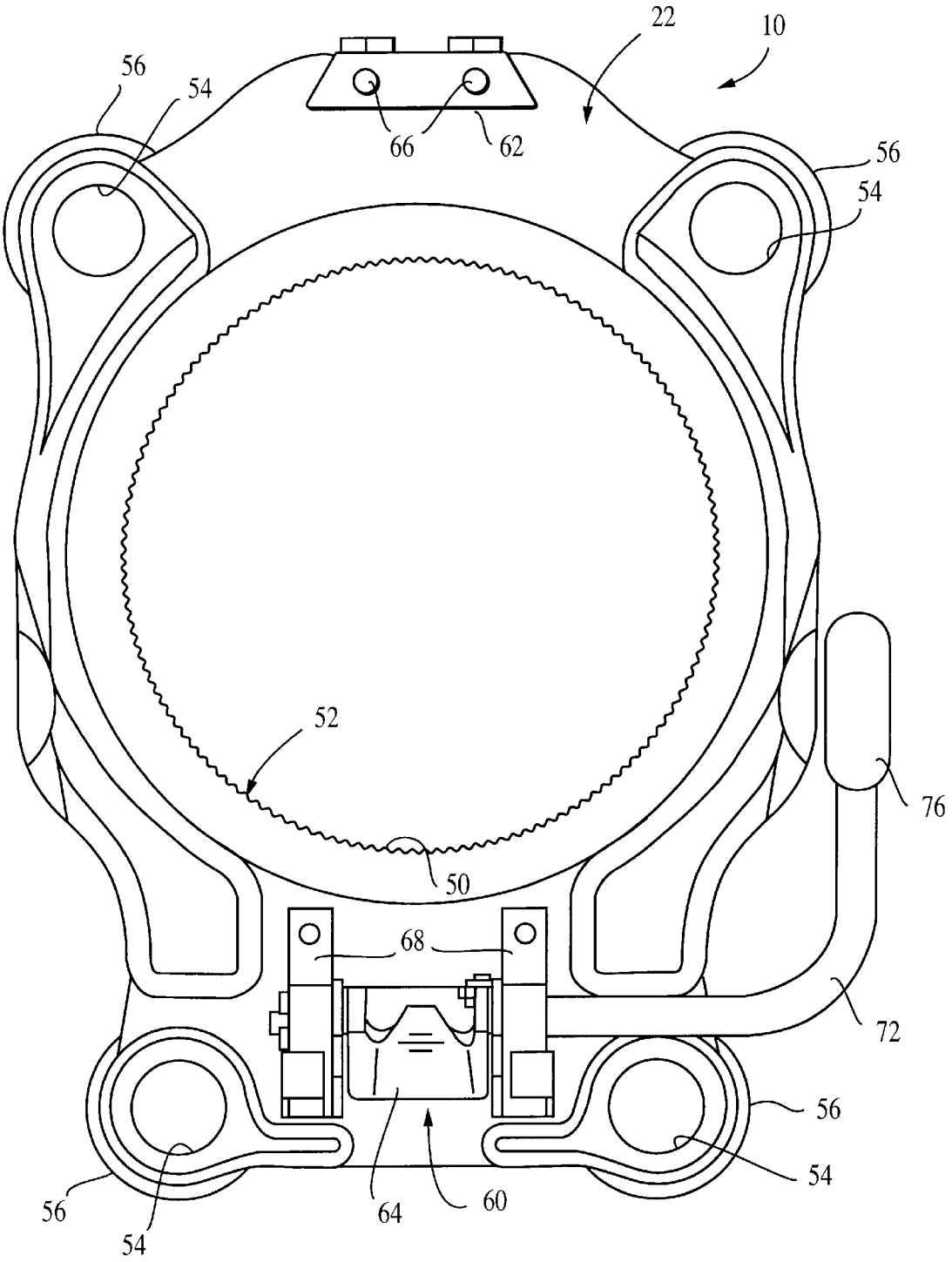
FIG. 6 is a top plan view of the base plate for the binding mechanism illustrated in FIGS. 1–5 with the adjustment disk removed.

Referring now to FIG. 6, base plate 22 has a centrally relocated opening 50 with internal circumferential teeth 52, which are designed to engage locking members 42 for locking base plate 22 relative to adjustment disk 20 and snowboard 12 at various angular positions. Teeth 52 of opening 50 are knurled teeth with each tooth forming approximately three degrees of opening 50. Base plate 22 also has an aperture 54 located in each of its corners for frictionally receiving a damping gasket 56 therein.

Referring now to FIGS. 3 and 6, damping gaskets 56 come in varying heights to take up play between the snowboard boot and the snowboard binding 10. By selecting the appropriate damping gaskets 56, the rider can maximize or eliminate any roll between the boot and binding. The rider can also put higher gaskets 56 on one side of the binding to cant the snow boot in one direction. The gaskets 56 also hold the base plate 22 above the upper surface of the snowboard 12 so that the hard rigid material of the base plate 22 does not contact the upper surface of the snowboard 12.

Figure 2:
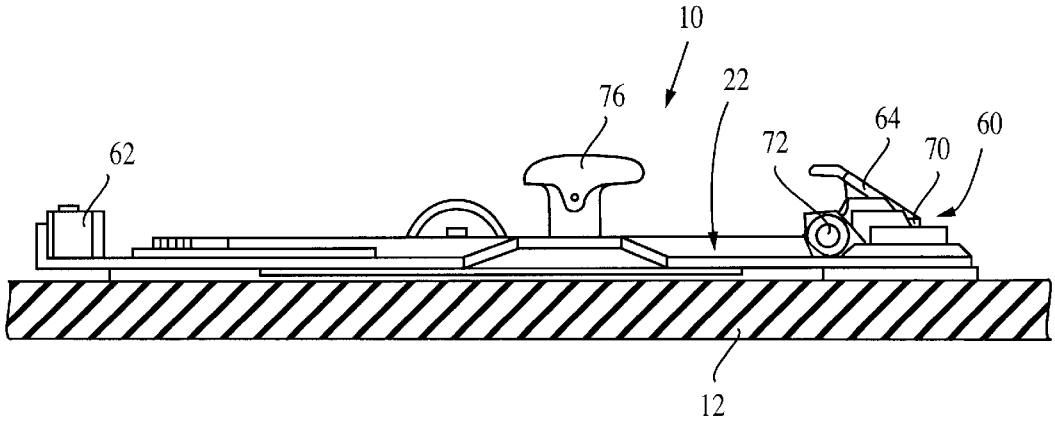
FIG. 2 is a partial side edge elevational view of the snowboard and binding mechanism illustrated in FIG. 1 in accordance with the first embodiment of the present invention.

Referring now to FIGS. 1–3, a binding 60 is coupled to the upper surface of the base plate 22. Binding 60 includes a front receptor or cleat engagement member 62 and a rear receptor or cleat engaging member 64. A pair of fasteners 66 fixedly and non-movably secures the front receptor 62 to the upper surface of base plate 22. Rear receptor 64 is movably coupled to the upper surface of base plate 22 by a pair of pivot blocks 68 which are fastened to base plate 22 via fasteners or screws 70. Rear receptor 64 is rotatably mounted on pivot shaft 72 and spring biased to a clamping position by spring 74. One of the free ends of pivot shaft 72 has a release handle 76 coupled thereto. By pulling upwardly on release handle 76, pivot shaft 72 rotates rear receptor 64 to release the rear cleat of the snow boot from the binding 60.

Of course, it will be apparent to those skilled in the art from this disclosure that the binding adjustment mechanism of the present invention can be used with other types of binds.

The control assembly for adjusting the angular position of base plate 22 and binding 60 thereon, basically includes control member 36, a pair of locking members 42 and the circumferential teeth 52 of base plate 22. As discussed below, locking members are preferably biased to their locked positions. Thus, rotation of control member 36 causes locking members 42 to disengage from circumferential teeth 52 of base plate 22. Once the angular position of base plate 22 and binding 60 have been adjusted, control member 36 is released and locking members 42 spring back to their locked positions. Therefore, base plate 22 and binding 60 can be easily adjusted relative to snowboard 12 without any tools.

In this embodiment, control member 36 preferably includes a pivot member 80, a handle portion 82, a retaining washer 84 and a pair of links 86 as shown in FIGS. 3–5 and 7. Pivot member 80 is rotatably mounted in center hole 34 of plate member 24 for moving locking member 42 between their locked positions and their release positions. In particular, pivot member 80 has a shaft portion 88 located within center hole 34 and an enlarged base portion 90 engaging the bottom surface of plate member 24. The upper end of shaft portion 88 of pivot member 80 has a pair of blind bores for receiving handle portion 82 thereon. The retaining washer 84 is positioned between handle portion 82 and the upper surface of plate member 24 for fixedly and rotatably coupling pivot member 80 to plate member 24.

Handle portion 82 is preferably a D-shaped ring member constructed of a rigid material such as a metallic wire. The handle portion 82 is designed to move between a retracted position and an extended position. In the retracted position, the handle portion 82 lies substantially flat against the plate member 24, while in the extended position, the handle portion 82 extends substantially perpendicular to base plate 22. Accordingly, handle portion 82 not only allows the user to easily rotate pivot member 80, but also secures pivot member 80 to plate member 24.

Links 86 are preferably fixedly secured at one end to the bottom surface of base portion 90 of pivot member 80 and fixedly secured at their other ends to one of the locking members 42. Accordingly, rotation of pivot member 80 causes links 86 to horizontally move locking members 42 between their locked positions and their release positions.

Locking members 42 are plate-shaped members, which are slidably located in the slot or recess 40 formed in adjustment disk 20 via support member 26. Preferably, a pair of biasing members 92 are located between locking members 42 and support members 26 of adjustment disk 20 to normally hold locking members 42 in their locked positions. Accordingly, rotation of control member 36 causes locking members 42 to move or retract from their locked positions to their release positions against the biasing forces of the biasing members 92. In the preferred embodiment, the biasing members 92 are compression springs. Of course, it will be apparent to those skilled in the art from this disclosure that a variety of biasing members can be utilized including, but not limited to, torsion springs, leaf springs, elastomeric members, etc.

Locking members 42 have an engagement end 94 with a plurality of mating teeth that mesh with the internal teeth 52 of opening 50 for preventing relative rotation between adjustment disk 20 and base plate 22. These teeth of engagement end 94 are knurled teeth with each tooth extending approximately three degrees to mate with teeth 52 of opening 50. Of course, it will be apparent to those skilled in the art from this disclosure that teeth 52 and the teeth of engagement end 94 can be other shapes, such as rectangular-shaped teeth.

The opposite end of locking members 42 are coupled to the control member 36 via horizontal links 86 for moving locking members 42 between their locked positions and their release positions. Of course, it will be apparent to those skilled in the art from this disclosure that the linkage mechanism of this embodiment can be modified to utilize a vertically arranged linkage mechanism to move locking members 42 between their locked positions and their release positions. The locking members 42 also include longitudinally extending slots, which are aligned with mounting slots 32 such that a mounting fastener can pass therethrough without obstructing the movement of locking members 42.

Modified Control Assembly

Figure 8:
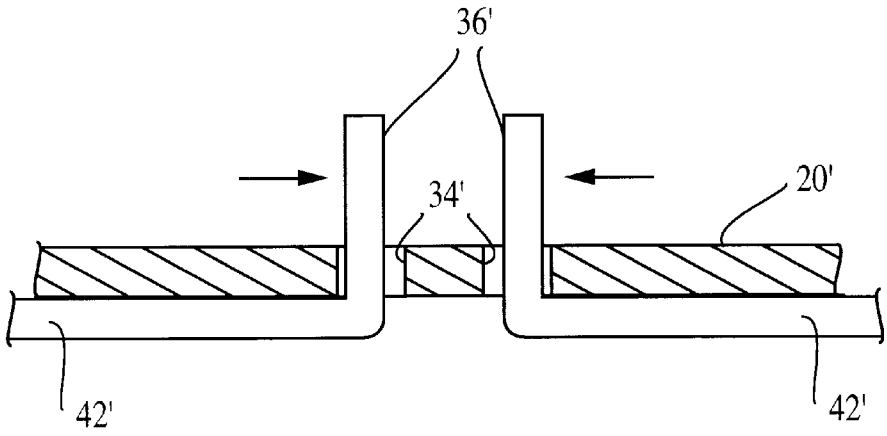
FIG. 8 is a modified control assembly for use with the snowboard binding adjustment mechanism illustrated in FIGS. 1–7.

Referring now to FIG. 8, a modified control assembly is illustrated for use with the binding mechanism 10 of the first embodiment. As shown in FIG. 8, the rotational control assembly of the first embodiment can be modified such that a pair of push levers 36' are coupled to locking members 42' and extend through openings 34' of the modified adjustment disk 20'. In this modification, the locking members 42' are moved against the bias of biasing members 92 (FIGS. 4 and 5) by squeezing control members or flanges 36' towards each other. This squeezing of control members or flanges 36' towards each other causes the teeth of locking members 42' to disengage from the internal teeth 52 of opening 50 of the base plate 22 (FIG. 5).

Alternate Embodiment

Figure 9:
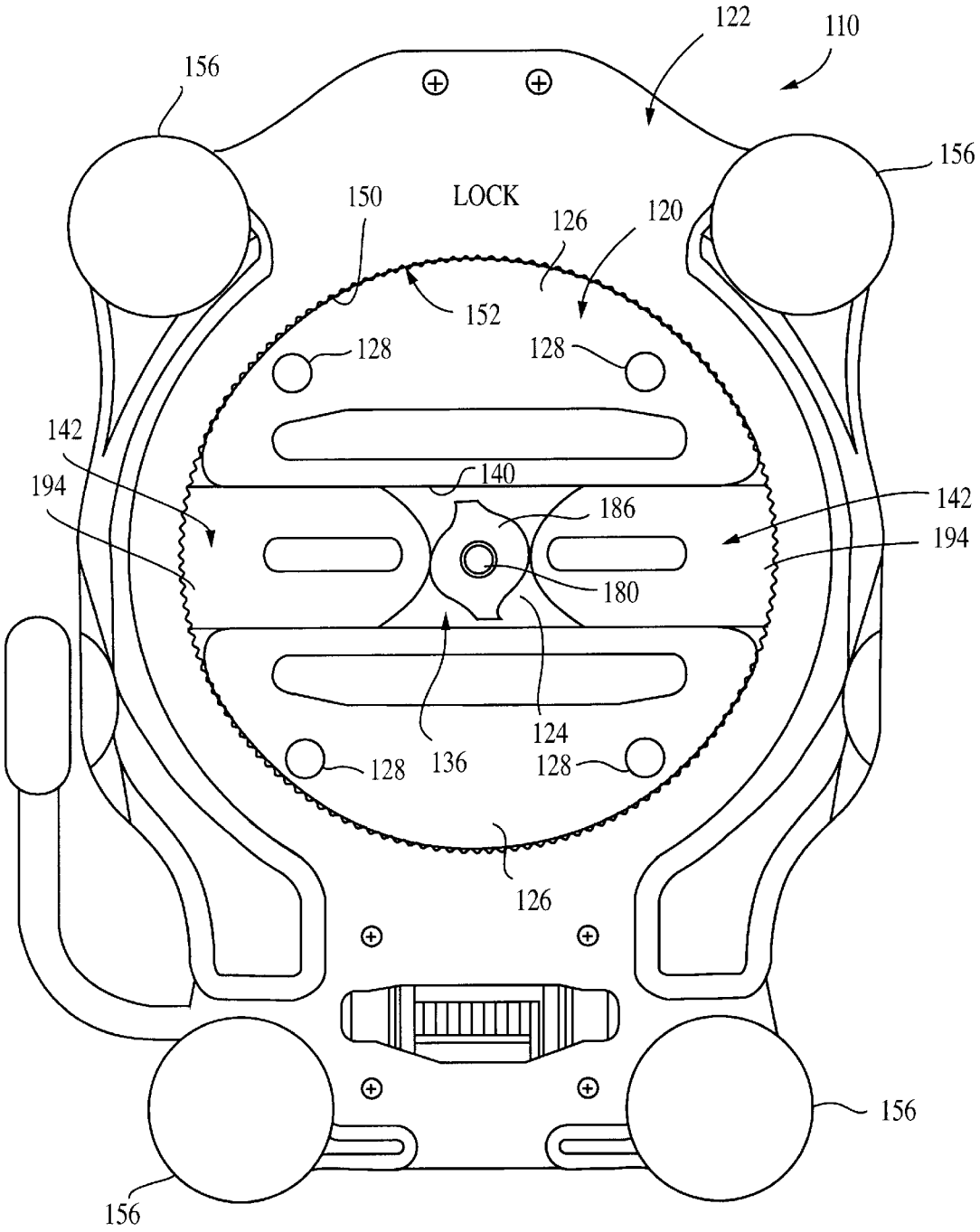
FIG. 9 is a bottom plan view of a snowboard binding adjustment mechanism with its locking members in the locked positions in accordance with another embodiment of the present invention.
Figure 10:
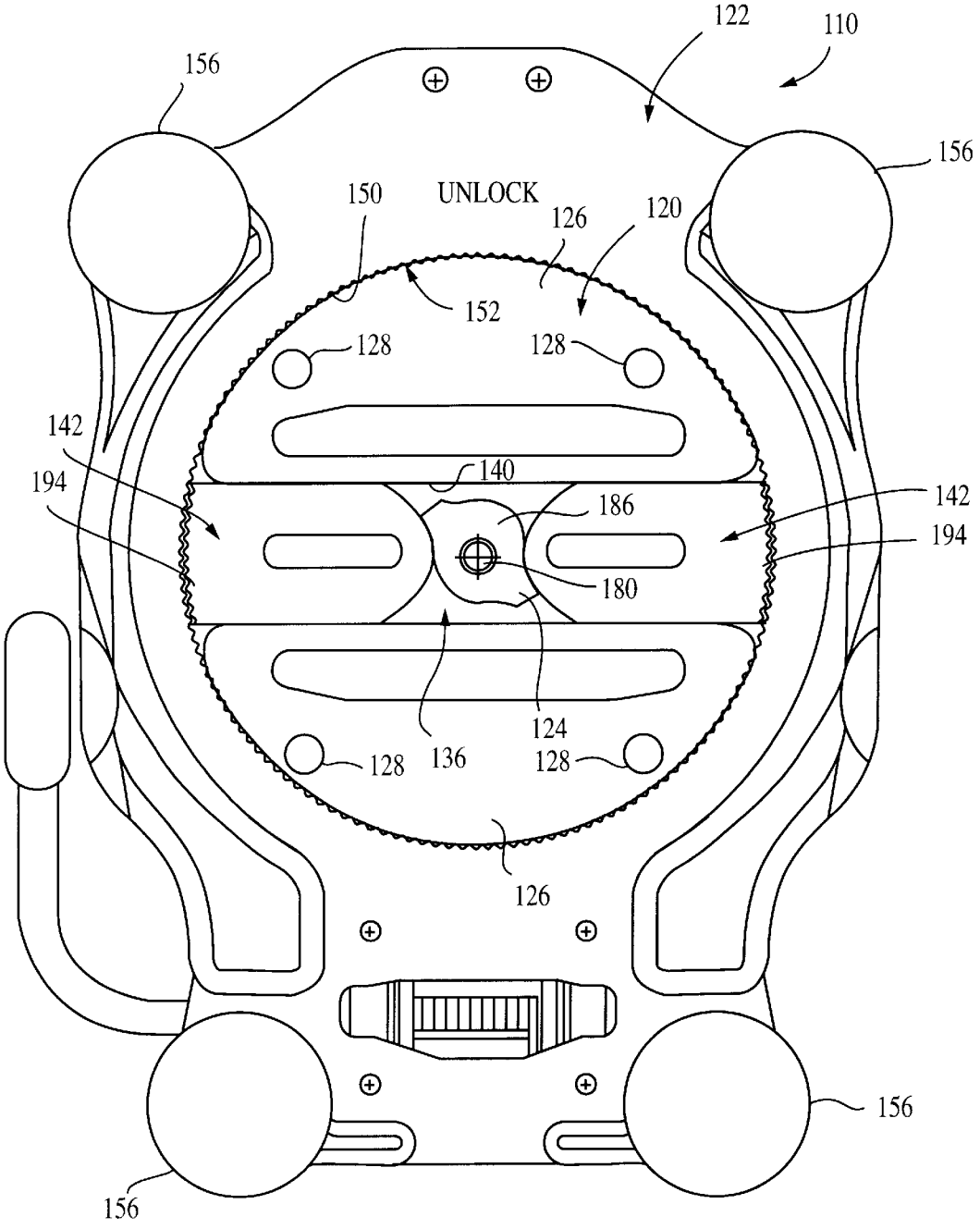
FIG. 10 is a bottom plan view of the snowboard binding adjustment mechanism illustrated in FIG. 9, but with the locking members in the unlocked positions.

Referring now to FIGS. 9 and 10, a binding mechanism 110 in accordance with another embodiment of the present invention is illustrated. This embodiment is similar to the binding mechanism 10, discussed above, except that links 86, base portion 90 and springs 92 have been replaced with a special cam portion 186 as discussed below. In other words, the control assembly for the binding mechanism 10 of the first embodiment has been modified such that the control member 36 utilizes a camming action instead of links 86. In view of the similarities between this embodiment and the first embodiment, binding mechanism 110 will not be discussed or illustrated in as much detail.

Basically, binding mechanism 110 includes an adjustment disk 120, which is adapted to be fixedly coupled to a snowboard, and a base plate 122, which is angularly adjustable relative to adjustment disk 120. Accordingly, adjustment disk 120 is non-movably secured to the snowboard, while base plate 122 is designed to be releasably coupled to the snowboard via adjustment disk 120. In the preferred embodiment, the base plate 122 can be adjusted in three-degree increments. Of course, the amount of adjustment can be modified as needed and/or desired.

Similar to the first embodiment, adjustment disk 120 is preferably constructed of three pieces. Specifically, adjustment disk 120 includes an upper plate member 124 and a pair of arc-shaped support members 126 coupled to the bottom surface of plate member 124 via fasteners or screws 128. Of course, adjustment disk 120 could be constructed as a one-piece, unitary member if needed and/or desired. Also, support members 126 can be attached to plate member 124 in a variety of ways. A rubber gasket or the like (not shown) is preferably positioned around support members 126 such that the gasket is located between the bottom surface of plate member 124 and the upper surface of base plate 122.

A transverse slot or recess 140 is formed between support members 126 for slidably receiving a pair of locking members 142. Locking members 142 are designed to slide within slot or recess 140 between locked positions and release positions such that the angular orientation of base plate 122 can be changed relative to the snowboard.

Base plate 122 has a centrally relocated opening 150 with internal circumferential teeth 152, which are designed to engage locking members 142 for locking base plate 122 relative to adjustment disk 120 and the snowboard at various angular positions. Base plate 122 also has damping gaskets 156 coupled to its bottom surface at the comers. Base plate 122 is constructed of a hard rigid material. Examples of suitable hard rigid materials for base plate 122 include various metals, as well as carbon and/or a metal/carbon combination.

The control assembly for adjusting the angular position of base plate 122, basically includes control member 136, a pair of locking members 142 and the circumferential teeth 152 of base plate 122. Control member 136 is designed such that rotation of control member 136 causes locking members 142 to disengage from circumferential teeth 152 of base plate 122. Therefore, base plate 122 can be easily adjusted relative to the snowboard without any tools.

In this embodiment, control member 136 is a pivot member 180 with a handle portion (not shown) and retaining washer (not shown) attached at one end, similar to the first embodiment, and a cam portion 186 attached to its other end as shown in FIGS. 9 and 10. Pivot member 180 is rotatably mounted in a center hole of plate member 124. In particular, control member 136 is rotatably coupled to plate member 124 in substantially the same manner as in the first embodiment. Accordingly, the handle portion of control member 136 is preferably a D-shaped ring member constructed of a rigid material such as a metallic wire.

Locking members 142 are plate-shaped members, which are slidably located in the slot or recess 140 formed in adjustment disk 120 via support member 126. Rotation of control member 136 causes cam portion 186 to move locking members 142 between their locked positions and their release positions. Since there is no positive engagement between cam portion 186 of control member 136 and locking members 142, it may be desirable to provide return springs between locking members 142 and adjustment plate 120.

Locking members 142 have an engagement end 194 with a plurality of teeth that mesh with the internal teeth 152 of opening 150 for preventing relative rotational between adjustment disk 120 and base plate 122. The opposite end of locking members 142 operatively engages cam portion 186 of control member 136. More specifically, cam portion 186 is shaped so that the width of cam portion 186 decreases as cam portion 186 is rotated from the locked position (FIG. 9) to the release position (FIG. 10).

Alternate Embodiment

Figure 11:
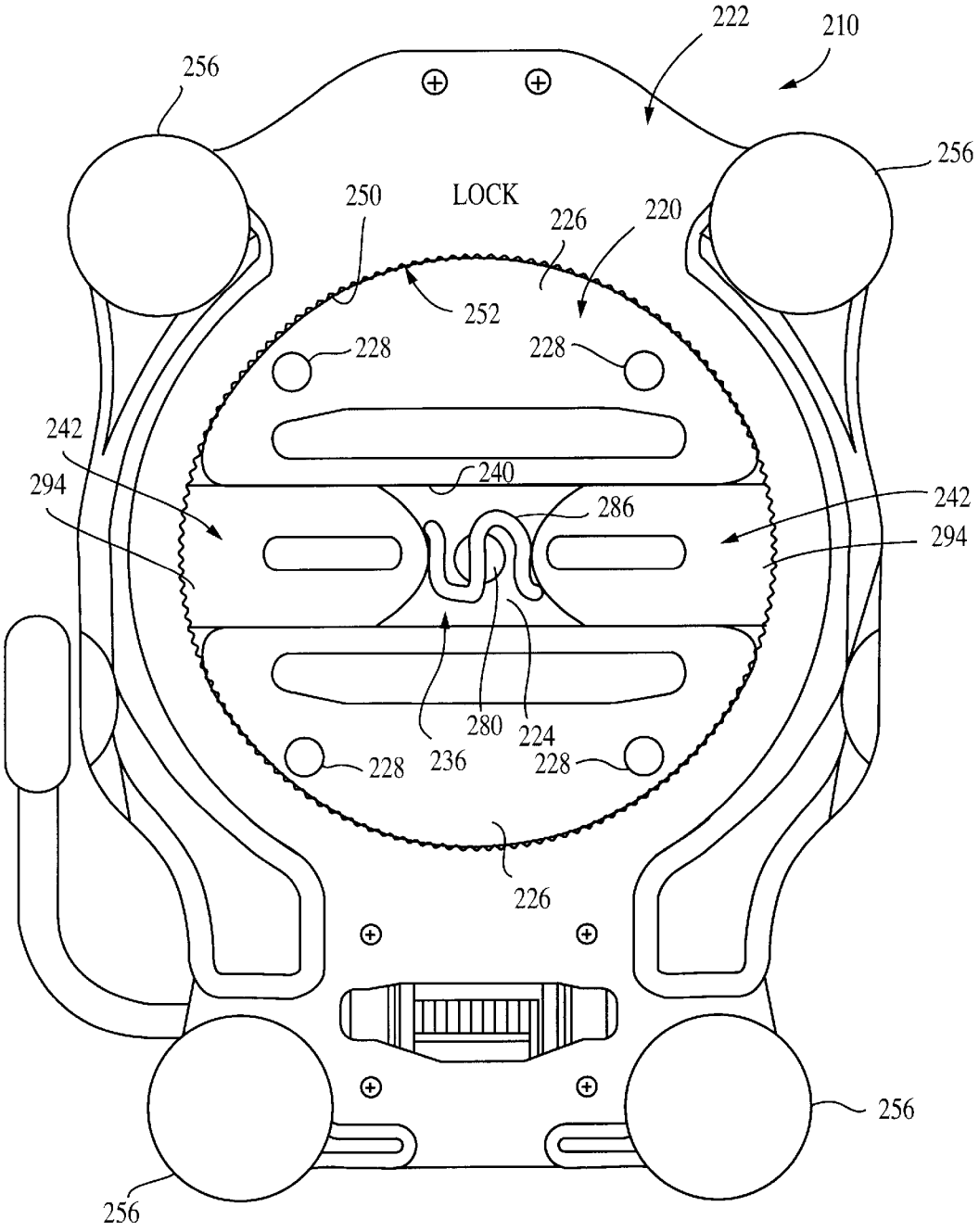
FIG. 11 is a bottom plan view of a snowboard binding adjustment mechanism with its locking members in the locked positions in accordance with another embodiment of the present invention.
Figure 12:
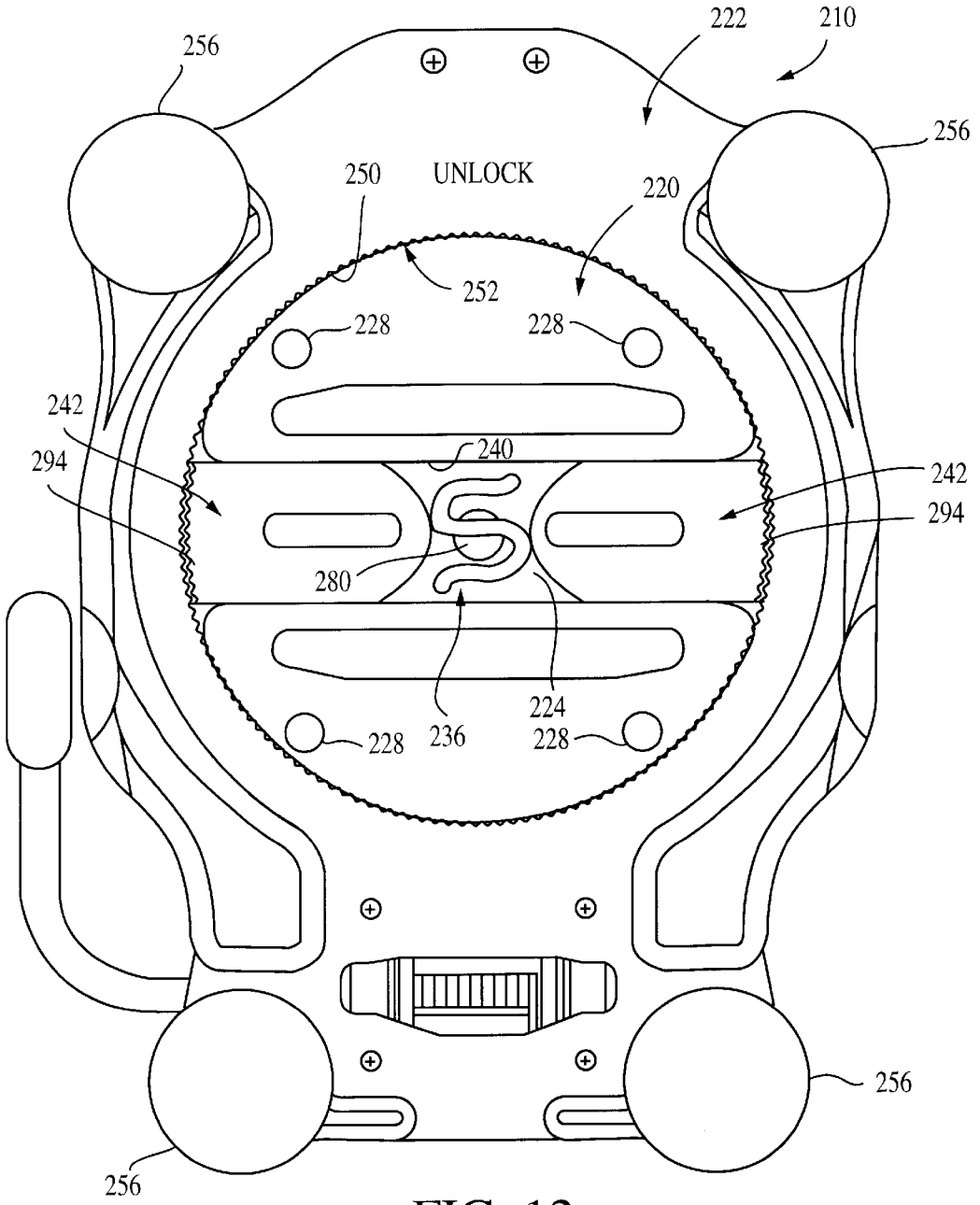
FIG. 12 is a bottom plan view of the snowboard binding adjustment mechanism illustrated in FIG. 11, but with the locking members in the unlocked positions.
Figure 13:
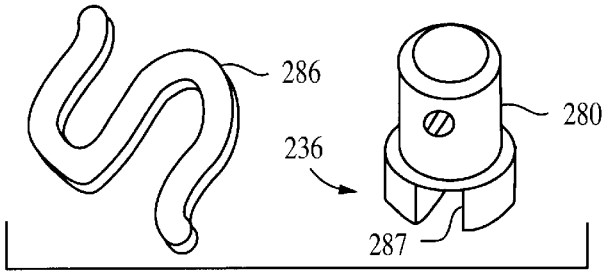
FIG. 13 is an enlarged, exploded perspective view of the control assembly for the snowboard binding adjustment mechanism illustrated in FIGS. 11 and 12.

Referring now to FIGS. 11–13, another binding mechanism 210 is illustrated in accordance with the present invention. This embodiment is similar to the binding mechanism 110, discussed above, except that control member 236 of this embodiment has been modified to provide a spring action. In view of the similarities between this embodiment and the prior embodiments, binding mechanism 210 will not be discussed or illustrated in as much detail. Rather, it will be apparent to those skilled in the art from this disclosure that the various parts and descriptions of the prior embodiments apply to the similar or identical parts of this embodiment.

Basically, binding mechanism 210 includes an adjustment disk 220, which is adapted to be fixedly coupled to a snowboard, and a base plate 222, which is angularly adjustable relative to adjustment disk 220. Accordingly, adjustment disk 220 is non-movably secured to the snowboard, while base plate 222 is designed to be releasably coupled to the snowboard via adjustment disk 220. In the preferred embodiment, the base plate 222 can be adjusted in three-degree increments. Of course, the amount of adjustment can be modified as needed and/or desired.

Similar to the first embodiment, adjustment disk 220 is preferably constructed of three pieces. Specifically, adjustment disk 220 includes an upper plate member 224 and a pair of arc-shaped support members 226 coupled to the bottom surface of plate member 224 via fasteners or screws 228. Of course, adjustment disk 220 could be constructed as a one-piece, unitary member if needed and/or desired. Also, support members 226 can be attached to plate member 224 in a variety of ways. A rubber gasket or the like (not shown) is preferably positioned around support members 226 such that the gasket is located between the bottom surface of plate member 224 and the upper surface of base plate 222.

A transverse slot or recess 240 is formed between support members 226 for slidably receiving a pair of locking members 242. Locking members 242 are designed to slide within slot or recess 240 between locked positions and release positions such that the angular orientation of base plate 222 can be changed relative to the snowboard.

Base plate 222 has a centrally relocated opening 250 with internal circumferential teeth 252, which are designed to engage locking members 242 for locking base plate 222 relative to adjustment disk 220 and the snowboard at various angular positions. Base plate 222 also has damping gaskets 256 coupled to its bottom surface at the corners. Base plate 222 is constructed of a hard rigid material. Examples of suitable hard rigid materials for base plate 222 include various metals, as well as carbon and/or a metal/carbon combination.

The control assembly for adjusting the angular position of base plate 222, basically includes control member 236, a pair of locking members 242 and the circumferential teeth 252 of base plate 222. Control member 236 is designed such that rotation of control member 236 causes locking members 242 to disengage from circumferential teeth 252 of base plate 222. Therefore, base plate 222 can be easily adjusted relative to the snowboard without any tools.

In this embodiment, control member 236 is a pivot member 280 with a handle portion (not shown) and retaining washer (not shown) attached at one end, similar to the first embodiment, and a cam portion 286 attached to its other end via slot 287 as shown in FIGS. 11–13. Cam portion 286 is an S-shaped spring member, which applies a biasing force to the inner ends of locking members 242 when in their locked positions. Pivot member 280 is rotatably mounted in a center hole of plate member 224. In particular, control member 236 is rotatably coupled to plate member 224 in substantially the same manner as in the first embodiment. Accordingly, the handle portion of control member 236 is preferably a D-shaped ring member constructed of a rigid material such as a metallic wire.

Locking members 242 are plate-shaped members, which are slidably located in the slot or recess 240 formed in adjustment disk 220 via support member 226. Rotation of control member 236 causes cam portion 286 to move locking members 242 between their locked positions and their release positions. Locking members 242 have an engagement end 294 with a plurality of teeth that mesh with the internal teeth 252 of opening 250 for preventing relative rotational between adjustment disk 220 and base plate 222.

The opposite end of locking members 242 operatively engages cam portion 286 of control member 236. More specifically, cam portion 286 is shaped so that the width of cam portion 286 decreases as cam portion 286 is rotated from the locked position (FIG. 11) to the release position (FIG. 12). Moreover, when cam portion 286 is in the locked position (FIG. 11), cam portion 286 is slightly deflected inwardly to apply an outward biasing force on locking members 242.

While three embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. A snowboard binding adjustment mechanism, comprising:

an adjustment disk adapted to be fixedly coupled to an upper surface of a snowboard;

a base plate having an opening with internal circumferential teeth and said adjustment disk being located within said opening of said base plate for relative selective rotation of said base plate about said adjustment disk;

a first locking member disposed within said opening of said base plate and movably arranged relative to said adjustment disk and said base plate for movement between a locked position and a release position, said first locking member having an engagement end that contacts said internal circumferential teeth in said locked position and is spaced from said internal circumferential teeth in said release position; and a control member having a pivotable portion disposed within said opening of said base plate and rotatably coupled to said adjustment disk about a rotational axis extending substantially perpendicular to said adjustment disk, said pivotable portion being rotatable and operatively coupled to said first locking member to move said first locking member between said locked position and said release position upon rotation of said pivotable portion.

2. A snowboard binding adjustment mechanism according to claim 1, further comprising a binding fixedly coupled to said base plate for movement therewith, said binding having a pair of receptors with one of said receptors being rotatable mounted on a pivot shaft and biased to a clamping position by a spring such that said binding is adapted to releasably couple a snowboard boot thereto.

3. A snowboard binding adjustment mechanism according to claim 1, further comprising a second locking member movably arranged relative said adjustment disk and said base plate for movement between a locked position and a release position.

4. A snowboard binding adjustment mechanism according to claim 1, wherein said adjustment disk has a pair of mounting slots for receiving fasteners to couple said adjustment disk to the snowboard.

5. A snowboard binding adjustment mechanism according to claim 1, wherein said adjustment disk has a recess for movably receiving said first locking member therein.

6. A snowboard binding adjustment mechanism according to claim 5, further comprising a second locking member movably arranged in said recess of said adjustment disk for movement between a locked positions and a release positions.

7. A snowboard binding adjustment mechanism according to claim 6, wherein said adjustment disk includes a plate member with said control member rotatably coupled thereto and a pair of support members fixedly coupled to said plate member to form said recess.

8. A snowboard binding adjustment mechanism according to claim 1, wherein said control member includes a handle portion for rotating said pivotable portion relative to said adjustment disk.

9. A snowboard binding adjustment mechanism according to claim 8, wherein said handle portion is retractable between an inoperative position and an operative position.

10. A snowboard binding adjustment mechanism according to claim 1, wherein said control member includes a cam portion for moving said first locking member between said locked position and said release position upon rotation of said control member.

11. A snowboard binding adjustment mechanism according to claim 10, further comprising a binding fixedly coupled to said base plate for movement therewith, said binding having a pair of receptors with one of said receptors being rotatably mounted on a pivot shaft and biased to a clamping position by a spring such that said binding is adapted to releasably couple a snowboard boot thereto.

12. A snowboard binding adjustment mechanism according to claim 10, further comprising a second locking member movably arranged relative to said adjustment disk and said base plate for movement between a locked position and a release position by said cam portion.

13. A snowboard binding adjustment mechanism according to claim 12, further comprising a binding fixedly coupled to said base plate for movement therewith, said binding having a pair of receptors with one of said receptors being rotatably mounted on a pivot shaft and biased to a clamping position by a spring such that said binding is adapted to releasably couple a snowboard boot thereto.

14. A snowboard binding adjustment mechanism according to claim 13, wherein said adjustment disk has a pair of mounting slots for receiving fasteners to couple said adjustment disk to the snowboard.

15. A snowboard binding adjustment mechanism according to claim 14, wherein said adjustment disk has a recess for movably receiving said locking members therein.

16. A snowboard binding adjustment mechanism according to claim 15, wherein said adjustment disk includes a plate member with said control member rotatably coupled thereto and a pair of support members fixedly coupled to said plate member to form said recess.

17. A snowboard binding adjustment mechanism according to claim 10, wherein said cam portion is a resilient member that is configured to be compressed when said first locking member is moved between said locked position and said release position.

18. A snowboard binding adjustment mechanism according to claim 12, wherein said cam portion is a substantially S-shaped spring with a pair of seats that hold said locking members in said locked positions.

19. A snowboard binding adjustment mechanism according to claim 18, wherein a binding fixedly coupled to said base plate for movement therewith, said binding being adapted to releasably couple a snowboard boot thereto.

20. A snowboard binding adjustment mechanism according to claim 19, wherein said adjustment disk has a pair of mounting slots for receiving fasteners to couple said adjustment disk to the snowboard.

21. A snowboard binding adjustment mechanism according to claim 20, wherein said adjustment disk has a recess for movably receiving said locking members therein.

22. A snowboard binding adjustment mechanism according to claim 20, wherein said adjustment disk includes a plate member with said control member rotatably coupled thereto and a pair of support members fixedly coupled to said plate member to form said recess.

23. A snowboard binding adjustment mechanism according to claim 21, wherein said control member includes a handle portion which is retractable between an inoperative position and an operative position.

24. A snowboard binding adjustment mechanism according to claim 1, wherein said control member includes a handle portion which is retractable between an inoperative position and an operative position.

25. A snowboard binding adjustment mechanism according to claim 1, wherein said control member includes a first link coupled to said locking member for moving said first locking member between said locked position and said release position upon rotation of said control member.

26. A snowboard binding adjustment mechanism according to claim 25, wherein a spring member is coupled between said first locking member and said adjustment disk for biasing said first locking member to said locked position.

27. A snowboard binding adjustment mechanism according to claim 25, further comprising a binding fixedly coupled to said base plate for movement therewith, said binding having a pair of receptors with one of said receptors being rotatable mounted on a pivot shaft and biased to a clamping position by a spring such that said binding is adapted to releasably couple a snowboard boot thereto.

28. A snowboard binding adjustment mechanism according to claim 25, further comprising a second locking member movably arranged relative to said adjustment disk and said base plate for movement between a locked position and a release position by said cam portion.

29. A snowboard binding adjustment mechanism according to claim 28, wherein first and second spring members are coupled between said adjustment disk and said first and second locking members f or biasing said first and second locking members to said locked positions.

30. A snowboard binding adjustment mechanism according to claim 29, further comprising a binding fixedly coupled to said base plate for movement therewith, said binding having a pair of receptors with one of said receptors being rotatably mounted on a pivot shaft and biased to a clamping position by a spring such that said binding is adapted to releasably couple a snowboard boot thereto.

31. A snowboard binding adjustment mechanism according to claim 30, wherein said adjustment disk has a pair of mounting slots for receiving fasteners to couple said adjustment disk to the snowboard.

32. A snowboard binding adjustment mechanism according to claim 31, wherein said adjustment disk has a recess for movably receiving said locking members therein.

33. A snowboard binding adjustment mechanism according to claim 32, wherein said adjustment disk includes a plate member with said control member rotatably coupled thereto and a pair of support members fixedly coupled to said plate ember to form said recess.

34. A snowboard binding adjustment mechanism according to claim 32, wherein said adjustment disk includes a plate member with said control member rotatably coupled thereto and a pair of support members fixedly coupled to said plate member to form said recess.

35. A snowboard binding adjustment mechanism, comprising:

an adjustment disk adapted to be fixedly coupled to an upper surface of a snowboard;

a base plate having an opening with internal circumferential teeth and said adjustment disk being located within said opening of said base plate for relative selective rotation of said base plate about said adjustment disk;

first and second locking members movably arranged relative to said adjustment disk and said base plate for radial movement within said opening between a locked position and a release position, each of said first and second locking members having an engagement end that contacts said internal circumferential teeth in said locked position and that is spaced from said internal circumferential teeth in said release position;

at least one spring member coupled to said first and second locking members to bias said first and second locking members to said locked position;

a control member disposed entirely within said opening of said base plate and coupled to said adjustment disk, said control member being operatively coupled to said first and second locking members to move said first and second locking members between said locked position and said release position; and a binding fixedly coupled to said base plate for movement therewith, said binding having a pair of receptors with one of said receptors being rotatably mounted on a pivot shaft and biased to a clamping position by a spring such that said binding is adapted to releasably couple a snowboard boot thereto.

36. A snowboard binding adjustment mechanism according to claim 35, wherein said control member is rotatably coupled to said adjustment disk to move said first locking member against said bias of said spring member from said locked position to said release position.

37. A snowboard binding adjustment mechanism according to claim 35, wherein said adjustment disk has a pair of mounting slots for receiving fasteners to couple said adjustment disk to the snowboard.

38. A snowboard binding adjustment mechanism according to claim 35, wherein said adjustment disk has a recess for movably receiving said locking members therein.

39. A snowboard binding adjustment mechanism, comprising:

an adjustment disk adapted to be fixedly coupled to an upper surface of a snowboard;

a base plate having an opening and two receptors disposed on opposite sides of said opening, said opening having internal circumferential teeth, said adjustment disk being located within said opening of said base plate for relative selective rotation of said base plate about said adjustment disk;

a first locking member disposed within said opening of said base plate and movably arranged relative to said adjustment disk and said base plate for movement between a locked position and a release position, said first locking member having an engagement end that contacts said internal circumferential teeth in said locked position and is spaced from said internal circumferential teeth in said release position; and a control member having a pivotable portion disposed within said opening of said base plate between said receptors, said pivotable portion being rotatably coupled to said adjustment disk about a rotational axis extending substantially perpendicular to said adjustment disk, said pivotable portion being rotatable and operatively coupled to said first locking member to move said first locking member between said locked position and said release position upon rotation of said pivotable portion.

* * * * *